US008493235B2

(12) United States Patent
Stählin

(10) Patent No.: US 8,493,235 B2
(45) Date of Patent: Jul. 23, 2013

(54) GEOBROADCAST HAZARD WARNING DEVICE VIA A SERVER

(75) Inventor: Ulrich Stählin, Eschborn (DE)

(73) Assignee: Continental Teves & Co. oHG (DE)

( * ) Notice: Subject to any disclaimer, the term of this patent is extended or adjusted under 35 U.S.C. 154(b) by 629 days.

(21) Appl. No.: 12/675,084

(22) PCT Filed: Apr. 25, 2008

(86) PCT No.: PCT/EP2008/055061

§ 371 (c)(1),
(2), (4) Date: May 19, 2010

(87) PCT Pub. No.: WO2009/030523

PCT Pub. Date: Mar. 12, 2009

(65) Prior Publication Data

US 2011/0063129 A1 Mar. 17, 2011

(30) Foreign Application Priority Data

Aug. 29, 2007 (DE) ..... 10 2007 040 987

(51) Int. Cl.
*G08B 21/00* (2006.01)

(52) U.S. Cl.
USPC ..... 340/905; 340/539.13; 701/300

(58) Field of Classification Search
USPC ... 340/539.1, 539.13, 900–905, 438; 701/300
See application file for complete search history.

(56) References Cited

U.S. PATENT DOCUMENTS

| | | | |
|---|---|---|---|
| 5,983,161 | A | 11/1999 | Lemelson |
| 6,084,510 | A | 7/2000 | Lemelson |
| 7,246,000 | B2 | 7/2007 | Odagawa et al. |
| 7,349,782 | B2 | 3/2008 | Churchill et al. |
| 2002/0035422 | A1 | 3/2002 | Sasaki |
| 2006/0015254 | A1 | 1/2006 | Smith |
| 2007/0040705 | A1 | 2/2007 | Yoshioka et al. |

FOREIGN PATENT DOCUMENTS

| | | | |
|---|---|---|---|
| DE | 4321348 | C1 | 5/1994 |
| EP | 0892381 | A | 1/1999 |
| WO | WO 01/48725 | A | 7/2001 |
| WO | WO2006024185 | A1 | 3/2006 |
| WO | WO2009000572 | A1 | 12/2008 |

*Primary Examiner* — Jeffery Hofsass
(74) *Attorney, Agent, or Firm* — RatnerPrestia

(57) ABSTRACT

A hazard warning for a driver of a vehicle is provided which involves measured values captured by different vehicles or corresponding advance analysis results being evaluated centrally by a server. The server then decides who needs to receive a corresponding warning. In this way, the main computation power can be provided in the server, which relieves the load on the individual vehicle systems. In addition, the data transfer can be minimized, since the messages are sent only to selected receivers.

11 Claims, 2 Drawing Sheets

GEOBROADCAST HAZARD WARNING DEVICE VIA A SERVER

CROSS REFERENCE TO RELATED APPLICATIONS

This application is the U.S. national phase application of PCT International Application No. PCT/EP2008/055061, filed Apr. 25, 2008, which claims priority to German Patent Application No. 10 2007 040 987.9, filed Aug. 29, 2007, the content of such applications being incorporated by reference herein.

FIELD OF THE INVENTION

The invention relates to safety and navigation engineering for vehicles. In particular, the invention relates to a hazard warning device for a vehicle, a control center, a hazard warning system, the use of a hazard warning unit in a vehicle, a method, a computer program product and a computer-readable medium.

BACKGROUND OF THE INVENTION

A geobroadcast involves information being sent to all the users in a locally limited environment around the transmitter. For DSRC (Dedicated Short Range Communication) this is an important technique for presenting local hazard warnings, etc. To allow a geobroadcast, it needs to be implemented in the network protocol. In what is known as vehicle-to-vehicle communication (C2X, Car-to-X Communication), geobroadcast is an essential function. Changes in the transmission protocol are usually necessary in order to allow the geobroadcast.

SUMMARY OF THE INVENTION

It is an object of the invention to provide improved hazard warning for a vehicle.

The invention specifies a hazard warning device for a vehicle, a control center, a hazard warning system, a use, a method, a computer program product and a computer-readable medium.

The exemplary embodiments described relate in equal measure to the hazard warning device, the control center, the hazard warning system, the use, the method, the computer program product and the computer-readable medium.

In line with one exemplary embodiment of the invention, a hazard warning device for a vehicle for warning a driver of an imminent hazard is specified, wherein the hazard warning device has a detection unit for capturing measured values which correspond to a hazard, a communication unit for sending data, which correspond to the captured measured values, to an external server and for receiving a directed warning from the server, and also a warning unit for outputting the warning to warn the driver of the hazard.

Such a hazard may be a queue, a vehicle which has been involved in an accident and is blocking the roadway, black ice, oil on the road or a wrong-way driver, for example.

In other words, there is a radio link between the central server and the communication unit in the relevant vehicle. During the journey, the detection unit in the vehicle records measured values. If these measured values indicate an acute hazard, for example, appropriate information data are sent to the server. From the received information, the server can generate an appropriate warning which it then sends to particular selected addresses (vehicles). In other words, the server decides who needs to receive the warning.

In contrast to DSRC, in which the application does not need to take on a filter function, the invention involves the control center or the server, and possibly together with the server, deciding the addressee (the application) to which the warning needs to be sent or whether the warning sent needs to be output to the driver by the relevant hazard warning device.

By way of example, the warning is output in conjunction with a digital map for a vehicle navigation system or a driver assistance system. By way of example, the warning can be depicted on an appropriate map detail together with a position statement and other information. At the same time or as an alternative, the driver can be warned audibly and/or haptically.

The term "digital maps" is also intended to be understood to mean maps for advanced driver assistance systems (ADAS) without any navigation taking place.

By way of example, the vehicle is a motor vehicle, such as a car, bus or heavy goods vehicle, or else is a rail vehicle, a ship, an aircraft, such as a helicopter or airplane or, by way of example, a bicycle.

In line with a further exemplary embodiment of the invention, the warning is based on an assessment of the data which have been transmitted from the communication unit to the server. This assessment is performed by the server.

In this way, it is possible for computation-intensive analyses to be performed outside of the vehicle in a central server unit. This allows lowering of the computation load on a vehicle control unit (in which the warning unit may be implemented) or else on an analysis unit integrated in the vehicle for the advance analysis of the measurement data. The analysis unit may also be integrated in the control unit.

In line with a further exemplary embodiment of the invention, the data at least comprise information about the nature of the hazard and a position for the hazard.

By way of example, the position of the hazard can be determined using a GPS module in the vehicle, possibly in association with compound navigation. The nature of the hazard is determined on the basis of the analysis of the measured values.

At this juncture, it should be pointed out that, within the context of the present invention, GPS is representative of all global navigation satellite systems (GMSS), such as GPS, Galileo, GLONASS (Russia), Compass (China), IRNSS (India), etc.

In line with a further exemplary embodiment of the invention, the communication unit is designed to send the data using a standardized radio link.

By way of example, the wireless transmission or the wireless reception of the data or of the warnings is effected by GSM, UMTS, WLAN (e.g. 802.11p) or else by WiMax. It is also possible to use other standardized transmission protocols.

In line with a further exemplary embodiment of the invention, the hazard warning device also has an analysis unit for performing an in-vehicle first analysis (advance analysis) of the measured values and for determining whether the captured measured values are related to a hazard. In this case, the communication unit is designed to send the data when the analysis unit has identified a hazard.

In-vehicle advance analysis of the captured measured values thus takes place. If this analysis indicates an imminent hazard, corresponding information is sent to the control center.

In line with a further exemplary embodiment of the invention, the communication unit is in permanent contact with the server and reports the position of the vehicle to the server at regular intervals.

In this way, the server always knows where each individual vehicle is situated, which means that the server can decide which vehicles need to be sent a particular warning.

In line with a further exemplary embodiment of the invention, the hazard warning device is designed to decide whether or not the directed warning is intended for this vehicle.

Thus, if the hazard warning device receives a warning from the control center, it can use direction information which is sent at the same time or which is integrated in the warning to assess whether or not the warning relates to the vehicle. In this way, it is possible to prevent the driver from being confronted by warnings which are of no interest to him.

In line with a further exemplary embodiment of the invention, a control center for a hazard warning system for warning a driver of a vehicle of an imminent hazard is specified, wherein the control center has a server. The server is designed to perform an assessment of received data which correspond to a hazard detected by a vehicle. In addition, the server generates a warning on the basis of this assessment, makes a selection from suitable receivers for the warning on the basis of received position data, and then sends a directed warning to the selected receiver(s).

In other words, the server decides those vehicles to which the warning needs to be transmitted.

In line with a further exemplary embodiment of the invention, the control center is designed to store information in the warning or in the data packet(s) which contain(s) the warning, wherein said information contains information about the local area in which the warning needs to be received or indicated to the relevant vehicle drivers.

In line with a further exemplary embodiment of the invention, the use of a hazard warning device as described above in a vehicle is specified.

In line with a further exemplary embodiment of the invention, a method for warning a driver of a vehicle of an imminent hazard is specified in which measured values which correspond to a hazard are captured, and data which correspond to the captured measured values are sent to an external server. In addition, the transmitted data are assessed and the warning is generated on the basis of said assessment. In addition, a selection regarding a receiver for the warning is made on the basis of received position data by various receivers, and a directed warning is sent from the server to the relevant receiver and received there. Subsequently, the warning is output to warn the driver of the hazard, for example visually and/or audibly.

In line with a further exemplary embodiment of the invention, a computer program product is specified which, when executed on a processor, instructs the processor to perform the following steps: assessment of received data which correspond to a hazard detected by a vehicle, generation of the warning on the basis of the assessment, selection of a receiver for the warning on the basis of received position data, and sending of a directed warning to the selected receiver.

This computer program product is designed particularly for execution on a processor in the server.

In line with a further exemplary embodiment of the invention, a computer-readable medium is specified which stores a computer program product which, when executed on a processor, instructs the processor to perform the steps described above.

A fundamental consideration of the invention can be seen in that the server and/or the application decides to who the warnings need to be sent or whether the warnings need to be taken into account. In other words, the server and/or the application (hazard warning unit in the vehicle) takes on a filter function.

Preferred exemplary embodiments of the invention are described below with reference to the figures.

BRIEF DESCRIPTION OF THE DRAWINGS

The invention is best understood from the following detailed description when read in connection with the accompanying drawings. Included in the drawings is the following figures.

Figure 1:
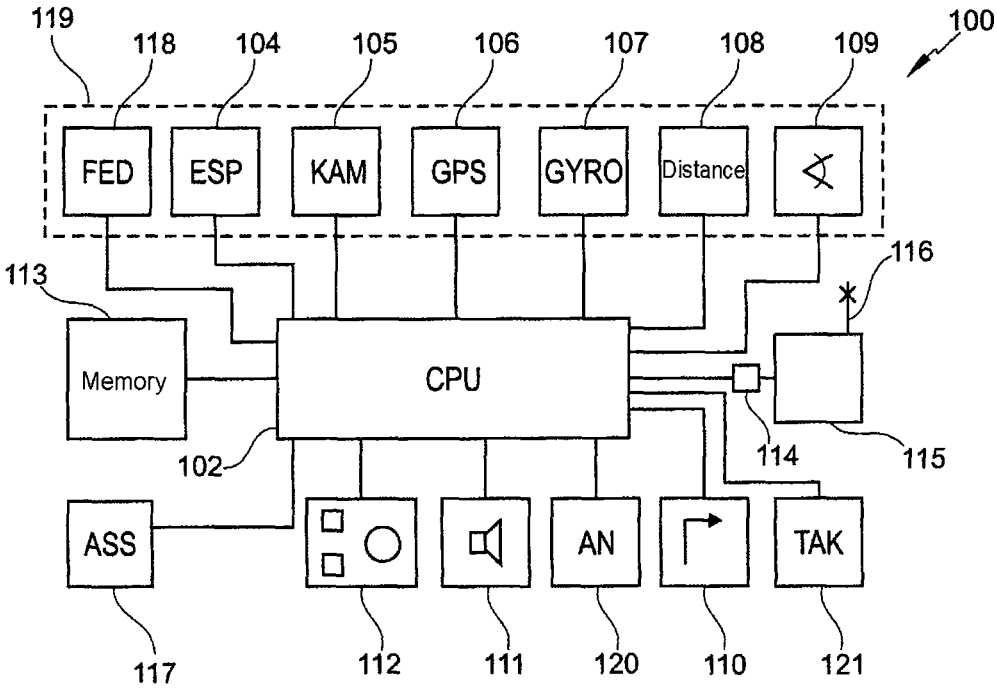
FIG. 1 shows a schematic illustration of a hazard warning device based on an exemplary embodiment of the invention.

The illustrations in the figures are schematic and not to scale.

DETAILED DESCRIPTION OF THE EMBODIMENTS

In the description of the figures which follows, the same reference numerals are used for the same or similar elements.

FIG. 1 shows a schematic illustration of components of a hazard warning device 100 which has a detection unit 119, a communication unit 115 with an antenna 116 and also has a warning unit 102, for example in the form of a CPU.

The warning unit 102 may be part of a central control unit, which is also part of the analysis unit 120.

The data to be sent, which are transmitted from the warning unit 102 or control unit 102 to the communication unit 115, can be encrypted using an encryption device 114. Similarly, the received data, which are transmitted from the communication unit 115 to the control unit 102, can be decrypted by the encryption unit 114.

In this way, it is possible to reduce the risk of misuse.

The hazard warning unit 102 has an input unit 112 connected to it. The input unit 112 can be used to make various adjustments to the hazard warning device and to a navigation unit linked thereto. However, the navigation unit is not absolutely necessary for the hazard warning unit according to aspects of the invention.

In addition, a visual output unit in the form of a monitor 110 is provided which can be used to output routing information and also the warnings, for example. Furthermore, the routing information and the warnings can also be output via an audible output unit 111 and/or a haptic unit 121. Output via the audible output unit 111 or haptic output unit 121 has the advantage that the driver is less distracted from what is currently happening in the traffic.

A memory element 113, which is connected to the warning unit 102 or is integrated in the warning unit 102, stores the digital map data (e.g. as navigation map data) in the form of data records, and, by way of example, the memory element 113 often stores additional information about traffic restrictions and the like in association with the data records.

In addition, a driver assistance system 117 is provided which is supplied with the digital map data.

For the purpose of determining the current vehicle position, the warning unit 102 has a navigation unit with a satellite navigation receiver 106 which is designed to receive navigation signals from Galileo or GPS satellites, for example. Naturally, the navigation unit with the satellite navigation receiver 106 may also be designed for other satellite navigation systems.

Since the navigation signals cannot always be received in city centers, for example, the hazard warning device also has a direction sensor 107, a distance sensor 108, a steering wheel angle sensor 109 and possibly also a spring excursion sensor 118 and also an ESP sensor system 104 and possibly a visual detector 105 for the purpose of performing compound navigation. By way of example, the visual detector 105 may be a camera. A radar sensor may also be provided.

The signals from the GPS receiver and from the other sensors are handled in the warning unit 102. The vehicle position ascertained from the signals is aligned with the roadmaps using map matching. The routing information obtained in this manner is finally output via the monitor 110.

In addition, the detection unit 119 is used for capturing measured values which are subsequently evaluated and analyzed by the analysis unit 120. If the analysis result indicates an imminent hazard, appropriate information describing the hazard in more detail is sent to the control center or to adjacent vehicles by means of the communication unit 115 together with the position data from the vehicle and/or with the position data from the detected hazard.

Figure 2:
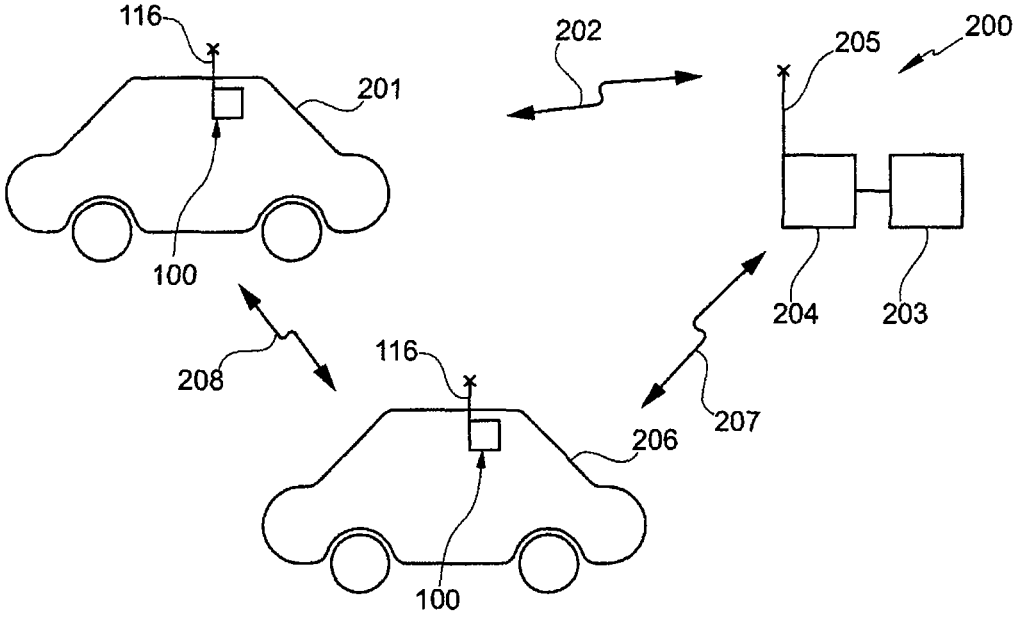
FIG. 2 shows a schematic illustration of a hazard warning system based on an exemplary embodiment of the invention.

FIG. 2 shows a schematic illustration of a hazard warning system based on an exemplary embodiment of the invention which has a hazard warning device 100 in a vehicle 201, a further hazard warning device 100 in a second vehicle 206 and a control center 200.

The control center 200 comprises a server 203 and a communication unit 204 with an antenna 205 for receiving information from the vehicles 201, 206 and for sending the warnings using the radio transmission link 202, 207.

In addition, the hazard warning devices 100 of the two vehicles 201, 206 can communicate with one another via the radio transmission link 208, which is a short-range radio link, for example, which means that only adjacent vehicles can be reached.

By way of example, the control center 200 is a traffic control center which manages, analyzes and allocates the received data or the generated warnings fully automatically.

Thus, when a vehicle or another facility identifies a hazard, this hazard is sent to the server 203 by standard radio link (e.g. GPRS or UMTS). The content of the message is at least the type of the hazard and the position. The server then assesses said hazard and decides the perimeter around the hazard in which said hazard needs to be announced. Next, the hazard warning is sent to all the vehicles in this perimeter.

This can likewise be done using GPRS, UMTS, etc. To this end, each vehicle using this service must be in permanent contact with the server and report its position at regular intervals. This allows the server to select the vehicles which are in the hazard region and therefore need to receive the warning.

Another option is to send the warning by DAB (Digital Audio Broadcast), TMC (Traffic Message Channel), etc. In this case, the message is used to store the region in which the message needs to be indicated, and the vehicle itself needs to establish whether it is in this region. Alternatively, it is also possible for just the position of the hazard to be transmitted, and the vehicle must then decide entirely on its own whether or not it is situated in a relevant region around the hazard.

The use of a server which actively decides to whom the hazard warning is sent means that the communication technology does not require changing. In addition, simple change options for processing the hazard and the dissemination thus arise, since all intelligence is located in the server.

Figure 3:
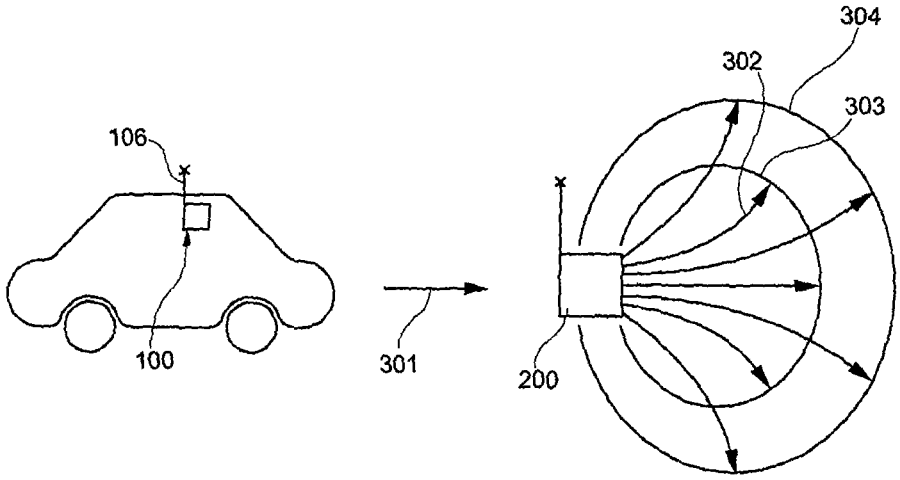
FIG. 3 shows a schematic illustration of a sequence for a hazard warning based on an exemplary embodiment of the invention.

FIG. 3 shows a schematic illustration of a sequence for a hazard warning based on an exemplary embodiment of the invention. First of all, measured values are captured by the hazard warning device 100 in the vehicle 201 and are analyzed in advance in the vehicle. If these measured values indicate a hazard, the nature of the hazard and the position of the hazard are transmitted via the communication link 301 to the control center 200. The control center then analyzes the received data and assesses them. In addition, the control center decides those vehicles to which an appropriate warning needs to be sent. The warning is then sent via the radio transmission link 302 to all vehicles which are situated in the area 303, for example. Should the analysis in the control center arrive at the result that the warning is of interest to a relatively large area, the warning is sent to all vehicles in the area 304. The control center does not need to be situated in the area 303 or in the area 304.

It is also possible for different warnings to be sent to the first group of vehicles in the area 303 and to the second group of vehicles in the area 304.

Figure 4:
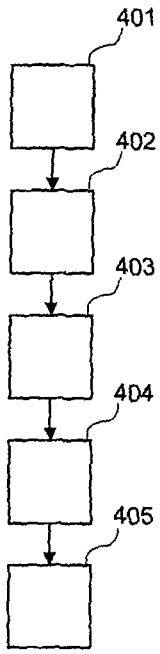
FIG. 4 shows a flow chart for a method based on an exemplary embodiment of the invention.

FIG. 4 shows a flow chart for a method based on an exemplary embodiment of the invention. In step 401, measured values are captured. In step 402, advice of a detected hazard is sent to a server by standardized radio link. In step 403, the hazard is assessed in the server, and the perimeter around the hazard in which the message about the hazard needs to be distributed is determined. In step 404, a hazard warning based on the analyzed radio link is then sent directly to the affected vehicles. As an alternative, the hazard warning is sent to all the vehicles by DAB, TMC, etc., including information regarding the region in which the message is relevant.

In step 405, the received warnings are output to warn the driver of the hazard.

In addition, it should be pointed out that "comprising" and "having" do not exclude other elements or steps, and "a" or "an" does not exclude a large number. Furthermore, it should be pointed out that features or steps which have been described with reference to one of the above exemplary embodiments can also be used in combination with other features or steps from other exemplary embodiments described above.

The invention claimed is:

1. A hazard warning device for a vehicle for warning a driver of an imminent hazard, said hazard warning device comprising:

a detection unit for capturing measured values which correspond to a hazard;

a communication unit for sending data, which correspond to the captured measured values, to an external server, and for receiving a directed warning from the server generated by the server assessing the captured measured values, wherein the communication unit sends the data to the server over a standardized radio link used for sending standardized communications to other devices, and wherein the hazard warning device is configured to decide whether or not the directed warning is intended for the vehicle; and a warning unit for outputting a warning to warn the driver of the hazard if it is decided that the warning is intended for the vehicle.

2. The hazard warning device as claimed in claim 1, wherein the warning is based on an assessment of the data by the server.

3. The hazard warning device as claimed in claim 1, wherein the data at least comprise information about a nature of the hazard and a position for the hazard.

4. The hazard warning device as claimed in claim 1 further comprising:

an analysis unit for an in-vehicle first analysis of the measured values and for determining whether the captured measured values are related to a hazard;

wherein the communication unit is configured to send the data when the analysis unit has identified a hazard.

5. The hazard warning device as claimed in claim 1, wherein the communication unit is in permanent contact with the server and reports a position of the vehicle to the server at regular intervals.

6. The use of a hazard warning device as claimed in claim 1 in a vehicle.

7. A hazard warning system for warning a driver of a vehicle of an imminent hazard, said hazard warning system comprising:

a hazard warning device as claimed in claim 1, a control center with a server for assessing transmitted data and for generating the warning on the basis of the assessment, wherein the control center directs the warning by using the warning to store information about the local area in which the warning is intended to be indicated.

8. The hazard warning system as claimed in claim 7, wherein the control center is configured to select a receiver for the warning on the basis of received position data and to send a directed warning to the selected receiver.

9. A control center for a hazard warning system for warning a driver of a vehicle of an imminent hazard, said control center comprising:

a server that is configured to:

assess received data which correspond to a hazard detected by a vehicle;

generate a warning on the basis of the assessment;

select a receiver for the warning on the basis of received position data;

send a directed warning to the selected receiver over a standardized radio link used for sending standardized communications to other devices, such that the selected receiver decides whether or not the directed warning is intended for the vehicle.

10. A method for warning a driver of a vehicle of an imminent hazard, said method comprising the following steps:

capturing, by the vehicle, measured values which correspond to a hazard;

sending, by the vehicle, data which correspond to the captured measured values to an external server;

assessing, by the server, the transmitted data;

generating, by the server, a warning on the basis of the assessment;

selecting a receiver for the warning on the basis of received position data;

receiving, by the vehicle, a directed warning from the server over a standardized radio link used for receiving standardized communications from other devices;

deciding, by the vehicle, whether or not the directed warning is intended for the vehicle; and outputting the warning to warn the driver of the hazard if it is decided that the warning is intended for the vehicle.

11. A non-transitory computer-readable medium which stores a computer program product which, when executed on a processor, instructs the processor to perform the following steps:

assessment, by the server, of received data which correspond to a hazard detected by a vehicle;

generation, by the server, of a warning on the basis of the assessment;

selection of a receiver for the warning on the basis of received position data;

sending of a directed warning to the selected receiver over a standardized radio link used for sending standardized communications to other devices, such that the selected receiver decides whether or not the directed warning is intended for the vehicle.

* * * * *

UNITED STATES PATENT AND TRADEMARK OFFICE

CERTIFICATE OF CORRECTION

PATENT NO. : 8,493,235 B2
APPLICATION NO. : 12/675084
DATED : July 23, 2013
INVENTOR(S) : Ulrich Stählin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 708 days.

Signed and Sealed this
Eighth Day of September, 2015

Michelle K. Lee

Michelle K. Lee
*Director of the United States Patent and Trademark Office*